United States Patent [19]

Farrar

[11] 3,967,666

[45] July 6, 1976

[54] BEDSIDE ARTICLE BAG

[76] Inventor: Sophia M. Farrar, 771 Douglas Drive, San Leandro, Calif. 94577

[22] Filed: Feb. 21, 1975

[21] Appl. No.: 551,824

[52] U.S. Cl. ..... 150/1
[51] Int. Cl.[2] ..... B65D 33/14
[58] Field of Search ..... 150/1, 52 R, 14; 224/35, 42.46 R

[56] References Cited

UNITED STATES PATENTS

| | | | |
|---|---|---|---|
| 1,362,162 | 12/1920 | Bradley | 224/35 |
| 1,485,067 | 2/1924 | Bristol | 224/35 UX |
| 1,513,514 | 10/1924 | London | 150/1 |
| 1,521,897 | 1/1925 | Martin | 150/1 X |
| 2,697,465 | 12/1954 | Johnson | 150/1 |
| 2,979,098 | 4/1961 | Greaves | 150/1 |

*Primary Examiner*—Donald F. Norton
*Attorney, Agent, or Firm*—Theodore J. Bielen, Jr.; Richard Esty Peterson

[57] ABSTRACT

An article bag for convenient storage of articles such as magazines, writing materials, games, and the like, the bag is formed of two washable cloth flaps supported in saddle fashion over a bed rail, the flaps have a plurality of storage pockets or compartments and include fasteners for fastening the flaps of the bag together to maintain a narrow profile by the interfastening of the flaps, the article bag is constructed to allow convenient bedside access to articles in the compartments on each side of the bag.

7 Claims, 10 Drawing Figures

FIG-4
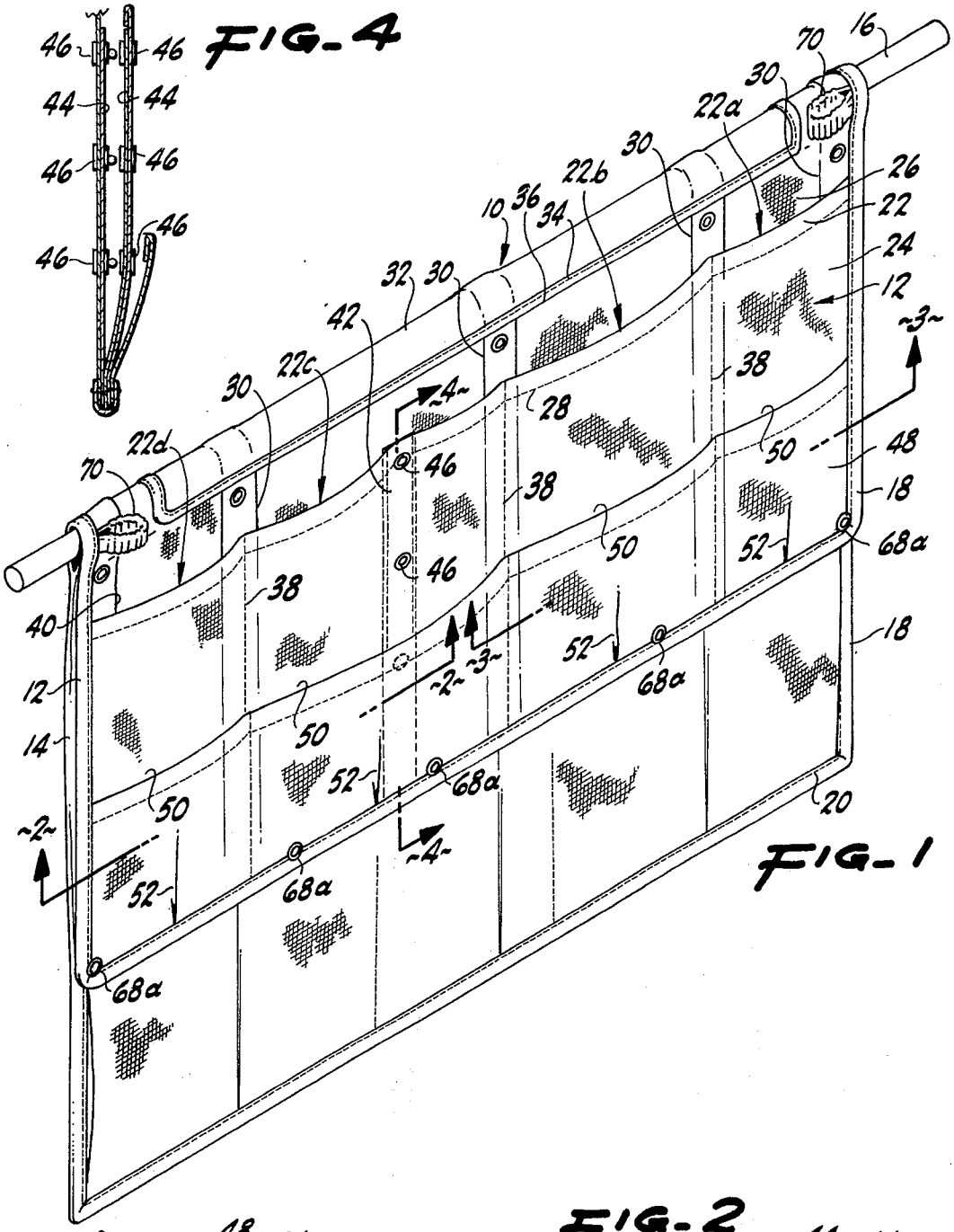
FIG-1
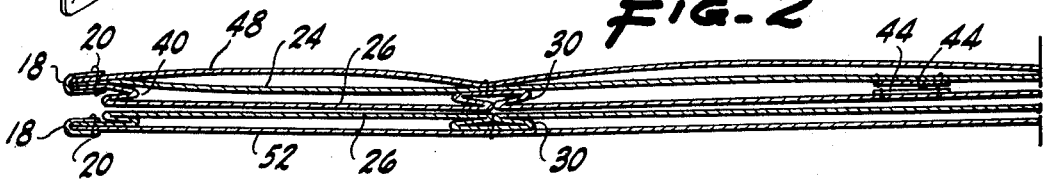
FIG-2
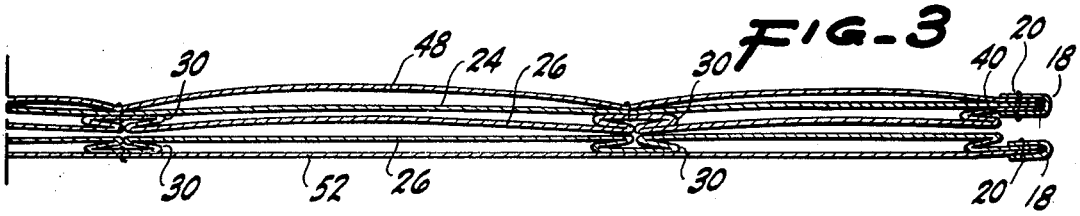
FIG-3

16
40
66b
66b
30
58
58
66b
66b
66b
66b
66b
66b
30
66a
26
26
30
66b 16
32
26
34
36
26

~9~
~9~
~7~
32
58
~10~
26
~10~
68b
56
68b
56
58
64
~8~
18
30
54
20
56
52
68b
~8~
62
64
30
68b
62
64
60
~7~
20
18

32
16
66b
66a
26
52
24
48
26
60

26
24
52
48
68b
68a
18
26

BEDSIDE ARTICLE BAG

BACKGROUND OF THE INVENTION

This invention relates to an article bag which is attachable to a bed rail, for storage of articles conveniently accessible to a patient convalescing in a hospital bed or the like. The article bag is particularly suitable to attachment to the side rail of a bed, but may be alternately attached to the end or foot rail of a bed which has no suitable side rail.

Often, patients confined to beds in hospitals or convalescent homes must depend on nurses or other attendants to provide them with the necessities and amenities needed during the period during which they are confined to their bed. This, of course, reduces the patient's feeling of self-reliance and places and unnecessary burden on those who must attend the patients. Employing specialized attendants to continually supply patients with reading materials, make-up kits, writing materials, or to retrieve fallen call-buttons, television channel selectors and other like tasks, detracts from the medical duties which are more crucial to the well being of the patients. The article bag is designed to relieve the attendants from such minor tasks by arranging the commonly needed articles of a patient in an orderly and readily accessible bag from which the patient himself can withdraw and replace those articles desired.

Being inexpensively fabricated from a cloth material, the article bag can be washed for reuse or may suitably be given to a patient after his stay in a hospital or other like institution. The cloth material will present no "breathing" problems accompanying the use of plastics. Plastics are customarily to be avoided in hospital environments where possible unless safety features such as multiple perforations in the plastic are included.

SUMMARY OF THE INVENTION

The bag comprises a substantially square or rectangular panel of material having a central segment that is positionable over the top of a bed rail allowing two contiguous side panels to depend from each side of the rail in saddle fashion. Each side panel includes a plurality of compartments or pockets suitable for storage of magazines or personal articles. The central segment includes further snap fasteners to secure the bag to the bed rail. Preferably the central segment also includes an elastic loop suitable for retaining a nurse call-button such that the button is most conveniently located to the reach of the patient. The pockets or compartments are of differing sizes to accommodate a variety of different articles. By pleating the rectangular panel, the capacity of the pockets, formed by a flat facing material, can be greatly increased. The two contiguous side panels or flaps are fastened together by additional snap fasteners such that a narrow profile is maintained even when numerous articles are stored in the bag. This narrow profile is important in order that the bag does not unduly expand causing interference with convenient attendance of the patient by staff personnel. Expansion of individual pockets, however, is permitted by a pleated type seam.

These and other features will become apparent from the detailed description of the preferred embodiment.

BRIEF DESCRIPTION OF THE DRAWINGS

FIG. 1 is a perspective view of the front of the article bag.

FIG. 2 is an enlarged cross-sectional view of a portion of the article bag taken on the lines 2—2 in FIG. 1.

FIG. 3 is an enlarged cross-sectional view of a portion of the article bag, continuing from the view in FIG. 2, taken on the lines 3—3 in FIG. 1.

FIG. 4 is a cross-sectional view of a portion of the article bag taken on the lines 4—4 in FIG. 1.

DETAILED DESCRIPTION OF THE PREFERRED EMBODIMENT

Figure 5:
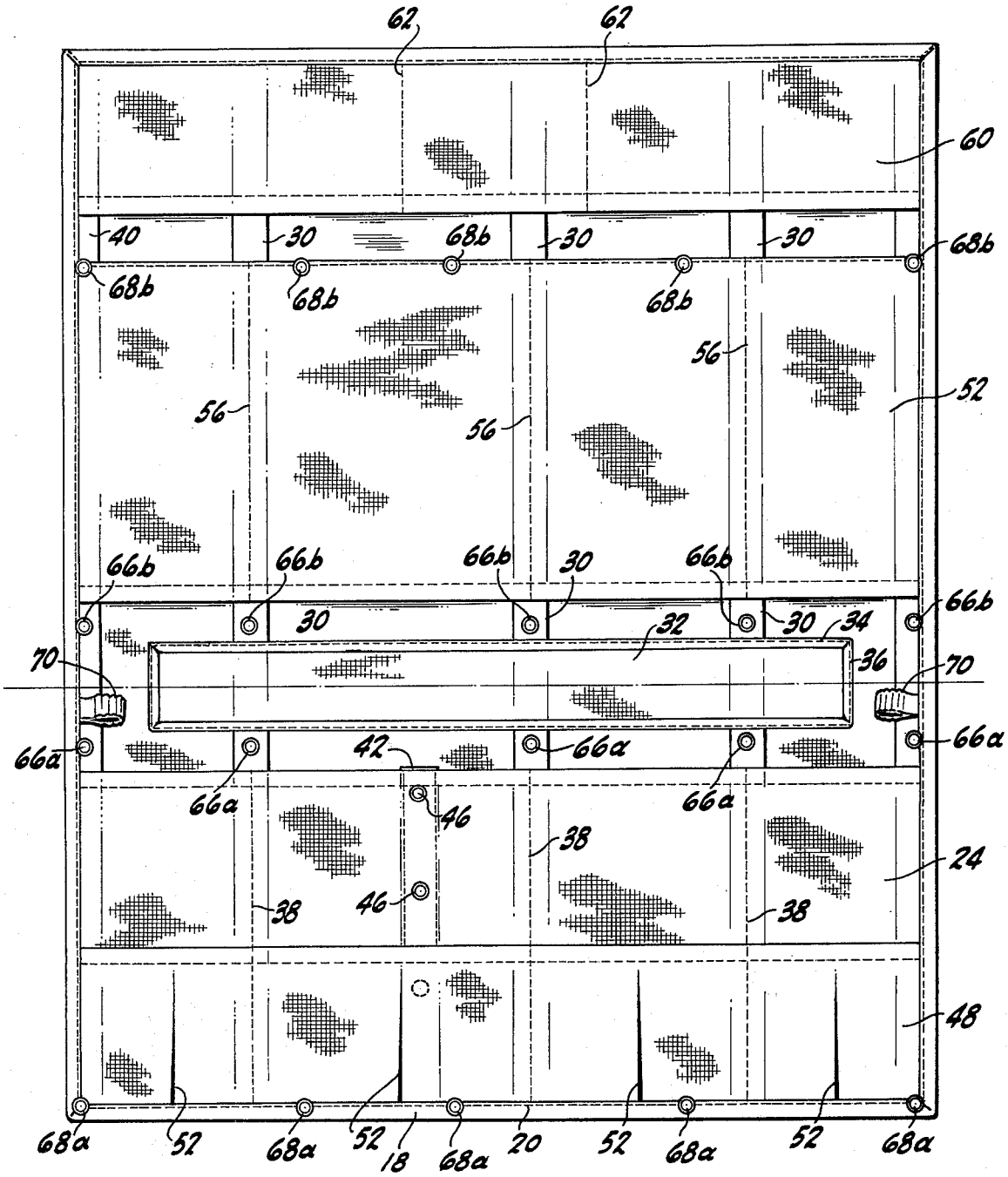
FIG. 5 is a plan view of the article bag laid flat.

Referring to FIG. 1, the article bag designated generally by the reference numeral 10 is illustrated in perspective showing, in detail, one side of the bag, arbitrarily termed the front flap 12. The article bag is constructed of a cloth material with both a front flap 12 and a rear flap 14 both of which contain a plurality of pockets. A perspective view of the article bag 10, detailing the rear flap 14, is shown in the perspective view of FIG. 6. The article bag is saddled over a bed rail 16 such that the two flaps depend therefrom. The front flap 12 is shorter than the rear flap in contemplation of the limited height between the bed rail 16 and the top of a mattress on a bed (not shown). In this respect, the front flap 12 faces the patient confined to his bed. The back flap 14 preferably depends at a greater length than the front panel, it not being so restricted by the bed.

Both flaps 12 and 14 have a rolled piping 18 around their peripheral border for purposes of appearance and strength. The piping provides additional material for a border seam 20, as shown in the continuum illustrations of FIGS. 2 and 3 and FIG. 5.

The front flap 12, as shown in FIG. 1, includes two rows of pockets. A top row 22 has a series of four pockets, 22*a*, *b*, *c*, *d*, extending in depth to the border seam 20 at the bottom of the flap. The pockets are formed by a first overlay panel 24 stitched to a backing panel 26 which is common to both the front and back flaps. In part, the periphery of the overlay panel has a seam in common with the border seam 20 of the flaps 12 and 14. The top of the overlay panel has a hem stitching 28.

In order to increase the capacity of the top row of pockets 22, the backing panel 26 has a series of overlying rib pleats 30 extending over bath flaps, as shown in FIG. 5. The rib pleats 30, shown in section in FIGS. 2 and 3, are secured in place by the border seam 20 at the bottom of the flaps and by an elongated cover path 32 which is stitched to the top of the backing panel by a border stitch 34 through a border piping 36. Vertical stitching 38, fastens the first overlay panel 24 to the center of the rib pleats 30, as shown in FIGS. 2 and 3. The side edges of the first overlay panel 24 have a side pleat 40, again to allow for the expansion of the pockets.

One of the pockets, 22*c*, includes a snap divider 42 allowing selective dividing of the pocket at the discretion of the user. This snap divider 42 is shown in cross section in FIG. 4. The snap divider 42 includes reinforcing backing strips 44 sewn to the backing panel 26 and the overlay panel 24. A series of conventional mating snap fasteners 46 (shown detached) may be engaged to divide the pocket 22*c* into two sub-pockets.

A second overlay panel 48 on the front flap is fastened to the backing panel 26 and over the first overlay panel 24 by the border seam 20 and common vertical stitching 38, which also divides the second overlay panel 48 into a second row of pockets 50. The row of pockets formed by the second overlay panel 48 are substantially shallower than the pockets 22 formed by the first overlay panel. The capacity of the pockets 50 can be increased moderately by a center pleat 52 in the overlay panel at each pocket, as shown in FIGS. 1 and 5.

Figures 6, 7, 8, 9, 10:
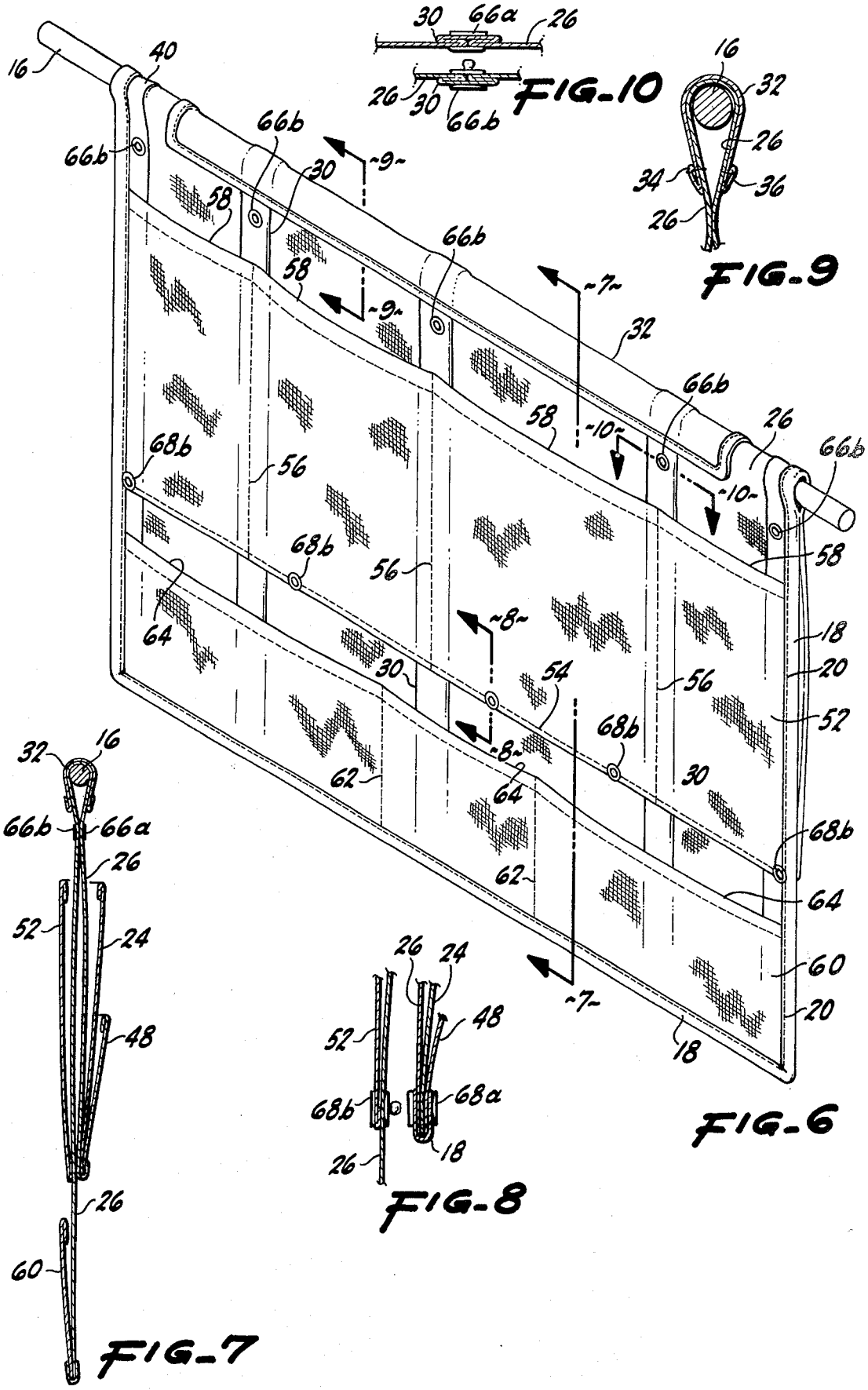
FIG. 6 is a perspective view of the back of the article bag of FIG. 1.
FIG. 7 is a cross-sectional view of the article bag taken on the lines 7—7 in FIG. 6.
FIG. 8 is an enlarged cross-sectional view of a portion of the article bag taken on the lines 8—8 in FIG. 6.
FIG. 9 is an enlarged cross-sectional exploded view of a portion of the article bag taken on the lines 9—9 in FIG. 6.
FIG. 10 is an enlarged cross-sectional exploded view of a portion of the article bag taken on the lines 10—10 in FIG. 6.

The back flap 14, shown in perspective in FIG. 6, is constructed in a somewhat similar manner as the front flap. A first overlay panel 52 is secured to the backing panel 26 at the sides by the common border stitching 20 and at the bottom by a separate bottom stitching 54. Vertical stitching 56 joining the overlay panel to the center of the rib pleats 30, divides the overlay panel 52 into a series of elongated pockets 58.

A second overlay panel 60 is secured to the backing panel 26 below the first overlay panel 52 rather than over the panel as described with regard to the front flap 12. The second overlay panel is secured at the sides and bottom by the common border stitching 20. Vertical stitching 62, joining second overlay panel 60 to the backing panel 26, divides the second overlay panel 60 into a series of pockets 64. The vertical stitching in this instance is not joined to the rib pleats 30, but is simply secured to the backing panel along preselected lines as a variation to the previously described construction.

The differences in the pocket arrangements for the front and back flaps 12 and 14, respectively, is most clearly illustrated in the cross-sectional view of FIG. 7.

The article bag, as shown in unengaged state in FIG. 5, is fastened to a bed rail in the following manner. The article bag is saddled over the bed rail 16 with the two flaps 12 and 14 depending from the rail such that the cover patch 32 is centered uppermost on the rail as shown in FIGS. 1, 6, 7, and 9. A series of top snap fasteners 66 are attached through the rib pleats and side pleats 40, one element 66*a* of the fastener arranged generally on one side of the cover patch 32 and the other element, 66*b*, arranged on the other side of the cover patch 32, as illustrated in FIG. 5. As schematically illustrated in FIG. 10, the element 66*a* is alignable and engageble with the element 66*b*, thereby securing the front flap 12 to the back flap 14 just below the bed rail 16, as shown in FIG. 7. The displacement of the fasteners from the bed rail 16 allows the article bag to be adapted to rails of varying size.

In order to maintain a narrow profile to the article bag, thereby minimizing any inconvenience to attendants, the article bag includes a second series of snap fasteners 68 spaced across the bottom of the front flap 12 and across the lower portion of the longer back flap 14. One element 68*a* of the snap fasteners is secured through the bottom periphery of the front flap 12, as shown in FIG. 1, and the other element 68*b* is secured through the lower portion of the back flap along the bottom of the first overlay panel 52 forming the top row of pockets 56. As shown schematically in FIG. 8, the elements 68*a* on the front flap 12 are in alignment with the elements 68*b* on the back flap 14 such that the elements are engageable, thereby securing the two flaps together. This arrangement prevents the flaps from being accidentally raised, for example, when changing bed linen or walking against the article bag, thereby causing spillage of the contents.

The article bag also includes two small elastic collars 70 which are secured under the peripheral piping 18 adjacent each end of the elongated cover patch 32. These collars 70 are included to retain a nurse call-button or a television remote control selector (not shown) which might otherwise become misplaced.

While in the foregoing specification an embodiment of the invention has been set forth in considerable detail for purposes of making a complete disclosure thereof, it will be apparent to those skilled in the art that numerous changes may be made in such details without departing from the spirit and principles of the invention.

What is claimed is:

1. An article bag for attachment to a bed rail comprising a first cloth flap and a second cloth flap said flaps having a common top portion adapted to be supported in saddle fashion over a rail with said flaps depending from each side of the rail, first fastening means having first and second cooperating fastening elements on said first and second flaps adjacent said top portion for fastening said article bag together under the rail, second fastening elements on said first and second flaps displaced from said top portion for fastening said first flap to said second flap, a plurality of first pockets on said first flap and a plurality of second pockets on said second flap; wherein said first and second flaps and said common top portion are formed of a continuous backing panel, and at least one first overlay panel across the backing panel having sides and a bottom attached to said backing panel on said first flap and at least one second overlay panel across the backing panel having sides and a bottom attached to said backing panel on said second flap, said overlay panels and backing panel having means for dividing said backing panel and said overlay panels into said plurality of pockets, said means for dividing said overlay panels into said plurality of pockets comprising a series of parallel pleats in said backing panel running the length of said panel from said first flap to said second flap, and a series of stitchings interconnecting said overlay panels with said backing panel along said pleats.

2. The article bag of claim 1 wherein said common top portion of said first and second flaps includes at least one collar adapted to retain a call-button and the like.

3. The article bag of claim 1 wherein said common top portion of said first and second flaps has a cover patch attached to said backing panel across said series of pleats.

4. The article bag of claim 1 having two first overlay panels across the backing panel having sides and bottoms attached to said backing panel one of said first overlay panels having shorter sides and being attached over said other first overlay panel with common attachment means at said sides and bottom with said other overlay panel.

5. The article bag of claim 4 having two second overlay panels across the backing panel, one of said overlay panels having sides and bottom attached to said backing panel and the other of said overlay panels having sides and bottom attached to said backing panel below said aforesaid overlay panel.

6. An article bag for attachment to a bed rail comprising a first cloth flap, and a second cloth flap said flaps having a common top portion adapted to be supported in saddle fashion over a rail with said flaps depending from each side of the rail, first fastening means having first and second cooperating fastening elements on said first and second flaps displaced from said top portion for fastening said first flap to said second flap, a plurality of first pockets on said first flap and a plurality of second pockets on said second flap; wherein said first and second flap and said common top portion are formed of a continuous backing panel, and at least one first overlay panel across the backing panel having sides and a bottom attached to said backing panel on said first flap and at least one second overlay panel across the backing panel having sides and a bottom attached to said backing panel on said second flap, said overlay panels and backing panel having means for dividing said backing panel and said overlay panels into said plurality of pockets, said means for dividing said overlay panels into said plurality of pockets comprising a plurality of fastener means arranged in series interconnecting said overlay panels with said backing panel.

7. An article bag for attachment to a bed rail comprising a first cloth flap and a second cloth flap said flaps having a common continuous top portion adapted to be supported in saddle fashion over a narrow rail with said flaps depending from each side of the rail, first fastening means comprising a first series of snap fasteners spatially mounted across said first flap and a second series of cooperating snap fasteners spatially mounted across said second flap proximate said first fasteners and adjacent said top portion, said first series and said second series of fasteners cooperating with said top portion for fastening the top portion of said article bag closely around the rail, wherein said top portion of said article bag rests over the rail and said snap fasteners are secured together under the rail, second fastening means having first and second flaps displaced from said top portion for fastening said first flap to said second flap, a plurality of first pockets on said first flap and a plurality of second pockets on said second flap.

* * * * *